US010399370B2

(12) United States Patent
Takahashi et al.

(10) Patent No.: US 10,399,370 B2
(45) Date of Patent: Sep. 3, 2019

(54) PRINTING APPARATUS

(71) Applicant: SEIKO EPSON CORPORATION, Tokyo (JP)

(72) Inventors: Yoji Takahashi, Matsumoto (JP); Masaki Kobayashi, Matsumoto (JP); Junya Kato, Matsumoto (JP); Yoshikazu Hama, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/901,428

(22) Filed: Feb. 21, 2018

(65) Prior Publication Data

US 2018/0236795 A1 Aug. 23, 2018

(30) Foreign Application Priority Data

Feb. 22, 2017 (JP) ..... 2017-030768

(51) Int. Cl.

| | |
|---|---|
| ***B41J 11/00*** | (2006.01) |
| ***B41J 15/04*** | (2006.01) |
| ***B41J 15/16*** | (2006.01) |
| ***B41J 15/18*** | (2006.01) |

(52) U.S. Cl.

CPC ..... *B41J 15/16* (2013.01); *B41J 11/009* (2013.01); *B41J 15/04* (2013.01); *B41J 15/165* (2013.01); *B41J 15/18* (2013.01)

(58) Field of Classification Search

CPC ..... B41J 15/18; B41J 15/22; B65H 23/105; B65H 2403/483; B65H 2301/23

See application file for complete search history.

(56) References Cited

U.S. PATENT DOCUMENTS

| | | | | |
|---|---|---|---|---|
| 2008/0091292 | A1* | 4/2008 | Gretsch | B65H 23/105 700/122 |
| 2012/0267468 | A1 | 10/2012 | Shiode | |
| 2013/0044153 | A1 | 2/2013 | Sasaki et al. | |
| 2013/0298790 | A1 | 11/2013 | Castells et al. | |

FOREIGN PATENT DOCUMENTS

| | | | |
|---|---|---|---|
| JP | 2003-326781 | A | 11/2003 |
| JP | 2017-030157 | A | 2/2017 |
| JP | 2017-043449 | A | 3/2017 |
| WO | WO 2017-017951 | | 2/2017 |

OTHER PUBLICATIONS

European Search Report issued in Application No. 18157952 dated Jun. 27, 2018.

* cited by examiner

*Primary Examiner* — Julian D Huffman
(74) *Attorney, Agent, or Firm* — Workman Nydegger

(57) ABSTRACT

The printing apparatus includes a supply section that supports a plurality of rolls into which roll-paper strips are wound and supplies the roll-paper strips, a transport section that applies respective transporting forces to the supplied roll-paper strips and transports the roll-paper strips, a printing section that performs printing onto the transported roll-paper strips, and a tension-imparting section that individually imparts respective tensile forces to a plurality of roll-paper strips against the transporting forces.

10 Claims, 7 Drawing Sheets

PRINTING APPARATUS

CROSS-REFERENCE TO RELATED APPLICATIONS

The present application claims priority to Japanese Patent Application No. 2017-030768, filed Feb. 22, 2017, which is hereby incorporated by reference in its entirety.

BACKGROUND

1. Technical Field

Embodiments of the present invention relate to a printing apparatus that can perform printing on a plurality of printing media in parallel.

2. Related Art

Printing apparatuses that can simultaneously print on a plurality of printing media in parallel are known. For example, JP-A-2003-326781 discloses a printing apparatus (an ink jet recording apparatus) that includes a plurality of supply rolls that supply printing media (strips of paper). The printing apparatus simultaneously prints on the printing media supplied from respective supply rolls. The printing apparatus enables a plurality of roll-paper strips (supply rolls) to be set on a single spindle (shaft). The roll-paper strips are transported to a printing region (or typing region) by transport rollers and nip rollers (pinch rollers).

However, the printing apparatus (ink jet recording apparatus) disclosed by JP-A-2003-326781 sometimes encounters a problem. For example, when a plurality of roll-paper strips are transported equally by the same transport system (with the same transport rollers and nip rollers (pinch rollers)), the transport rates (feed rates) of the roll-paper strips become different from each other. In other words, the transport accuracy becomes different among the plurality of printing media. This may lead to a difference in the quality of printed images among the roll-paper strips or may lead to an inability to obtain the best-quality print images on each of the roll-paper strips. Factors that cause feed rates of roll-paper strips to be different under the same driving conditions (feed conditions) of the transporting system include, for example, a difference in the surface specification and thickness of the roll-paper strips when the types of installed roll-paper strips are different. Another factor is a difference in tension due to changes in the roll diameter associated with consumption of the roll-paper.

SUMMARY

Embodiments of the invention can be implemented in application examples or forms described below.

Application Example 1

A printing apparatus according to an aspect of the invention includes a supply section that supports a plurality of rolls into which respective printing media are wound and that supplies the printing media, a transport section that imparts respective transporting forces to the supplied printing media and that transports the printing media, a printing section that performs printing on the transported printing media, and a tension-imparting section that imparts respective tensile forces onto the printing media against the transporting forces.

According to this configuration, the printing apparatus includes the supply section. The supply section supports a plurality of rolls into or onto which respective printing media are wound and supplies the printing media. The transport section of the printing apparatus imparts respective transporting forces to the supplied printing media and transports the printing media. The printing section of the printing apparatus performs printing on the transported printing media. In short, the printing apparatus according to this configuration can perform printing in parallel on a plurality of the printing media supplied from rolls or from different rolls. The printing apparatus also includes a tension-imparting section that imparts respective tensile forces onto the printing media against the transporting forces. Thus, when or if transporting rates (feed rates) under predetermined transporting forces become different depending on transported printing media, the difference in the transporting rate (feed rate) can be corrected by imparting tensile forces, which act against the transporting forces, to the printing media. As a result, the transport accuracy for a plurality of printing media can be further improved, and the difference in the quality of printed images can be suppressed.

Application Example 2

In an example of the printing apparatus, the transport section may have common transport rollers that transport the printing media side by side, and that the printing section may have a common printing head that performs printing on the printing media.

According to this configuration, the common transport rollers transport the printing media (e.g., all rolls) side by side, and the printing section that has the common printing head performs printing on the printing media (e.g., on all rolls). In other words, the printing apparatus can perform printing in parallel on a plurality of printing media supplied from rolls and can be constructed with a simple mechanism. However, when the common transport rollers transport a plurality of printing media, the amounts of slip of the respective printing media may become different depending on the types of the printing media (difference in material, width, etc.). As a result, the transporting accuracy of the printing media with respect to the common printing head may become different from each other. However, according to this configuration, the tension-imparting section can individually impart respective tensile forces onto the printing media against the transporting forces acting on the printing media. Thus, even in such a case, the difference in the transporting rate (feed rate) can be corrected by imparting the tensile forces, which act against the transporting forces, individually to the printing media. In other words, even with such a simple mechanism, the printing apparatus can reduce deterioration in the transport accuracy for a plurality of printing media and perform higher quality printing.

Application Example 3

In one example of the printing apparatus, the tension-imparting section imparts, onto the corresponding printing media, individual respective tensile forces. In one example, the amounts of the respective tensile forces are set according to types of the printing media.

According to this configuration, the tension-imparting section imparts, onto the corresponding printing media, individual respective tensile forces of which amounts are set according to types of the printing media. This enables appropriate correction when the amount of slip in transport by the transport section becomes different between types of the printing media (difference in material, width, etc.). Thus, the tensile forces applied to one printing medium from one roll may differ from the tensile forces applied to the printing medium from another roll.

Application Example 4

The printing apparatus may further include a medium recognition section that recognizes the respective types of the printing media. In the printing apparatus, the tension-imparting section imparts, onto the corresponding printing media, individual respective tensile forces of which amounts are set according to the recognized types of the printing media.

The printing apparatus may include the medium recognition section. The medium recognition system eliminates the necessity of entering the type of printing medium in the printing apparatus every time a printing medium is replaced. Moreover, the tension-imparting section individually imparts a predetermined amount of tensile force according to the recognized type of printing medium onto the corresponding printing medium. This enables appropriate correction when the amount of slip in transport by the transport section becomes different. The amount of slip may depend, for example, on the type of printing medium (difference in material, width, etc.). Thus, appropriate correction can be performed in a manner that accounts for each type of printing medium recognized by the medium recognition system.

Application Example 5

The printing apparatus may further include a width detecting section that detects respective widths of the printing media. In the printing apparatus, the tension-imparting section imparts, onto the corresponding printing media, individual respective tensile forces of which amounts are set according to the detected widths of the printing media.

According to this configuration, the printing apparatus includes the width detecting section, which eliminates the necessity of entering the width information of the printing medium in the printing apparatus every time the printing medium is replaced. In addition, the tension-imparting section imparts, onto the corresponding printing media, individual respective tensile forces of which amounts are set according to detected widths of the printing media. This enables appropriate correction when the amounts of slip in transport by the transport section become different. The amounts of slip may depend on the widths of printing media. Thus, appropriate correction can be performed by detecting the widths of the printing media.

Application Example 6

The printing apparatus may further include a transporting rate detection section that detects respective transporting rates of the printing media. In the printing apparatus, the tension-imparting section individually imparts the respective tensile forces of which amounts are set according to the detected transporting rates to the corresponding printing media.

According to this configuration, the printing apparatus includes the transporting rate detection section. Thus, the printing apparatus can detect an actual transported length, which is compared to that of the predetermined transporting rate of each printing medium to be transported (in other words, the printing apparatus can detect the amount of slip in transport, i.e., transport error). In addition, the tension-imparting section individually imparts the amount of tensile force that is set in accordance with the detected transporting rate to the corresponding printing medium. This enables appropriate correction when the amount of slip in transport by the transport section 60 (transport error) becomes different depending on the printing medium. Thus, individually imparted tensile forces can be set according to the amount of slip or based on the transport error.

Application Example 7

The printing apparatus may further include an input section into which respective transport characteristics of the printing media are entered. In the printing apparatus, the tension-imparting section imparts, onto the corresponding printing media, individual respective tensile forces of which amounts are set according to the entered transport characteristics.

According to this configuration, the printing apparatus includes the input section into which respective transport characteristics of the printing media are entered. The transport characteristics, such as amounts of slip (transport errors), are evaluated in advance for types of printing media. The input section enables the printing apparatus to recognize the transport characteristics. The tension-imparting section individually imparts the respective tensile forces of which amounts are set according to the entered transport characteristics of the printing media onto the corresponding printing media. This enables appropriate correction when the transport characteristics in transport by the transport section become different depending on the printing media. Thus, the input section allows an amount of slip or transport error to be corrected based on the transport characteristics. The correction is made, for example, by imparting the respective tensile forces.

Application Example 8

In the printing apparatus, the tension-imparting section have respective rotational drive devices that rotationally drive the rolls in the supply section. The tension-imparting section control may control individual respective tensile forces applied to the printing media by controlling respective driving torques that drive the rotational drive devices.

According to this configuration, the tension-imparting section has rotational drive devices that rotationally drive the rolls in the supply section. The tension-imparting section controls driving torques that drive the rotational drive devices and thereby controls individual respective tensile forces applied to the printing media. In other words, in the supply section, the tension-imparting section causes the rotational drive devices to supply printing media to the printing section (or to increase/decrease the supply loads). While doing so, the tension-imparting section controls driving torques that drive the rotational drive devices and thereby controls respective tensile forces that are individually applied to a plurality of printing media. With this configuration, the tension-imparting section can be formed as part of the function of the supply section. In other words, the tension-imparting section can be formed by using a function of the supply section. Consequently, the printing apparatus that can perform printing on a plurality of printing media in parallel can be constructed efficiently while enabling higher quality printing.

Application Example 9

In one example of the printing apparatus, the tension-imparting section be disposed upstream of the transport section on a transport path on which the printing media are transported.

According to this configuration, the tension-imparting section is disposed upstream of the transport section on the transport path on which the printing media are transported. Thus, the tension-imparting section can impart tensile forces that act on the printing media in a direction opposite to the transporting forces applied by the transport section. In other words, when the transport section transports a plurality of printing media and the amount of slip at the transport section (transport error) becomes different among the printing media, tensile forces acting in the direction opposite to the transporting forces are imparted to respective printing media in such a manner that the amounts of slip (transport errors) of the transport section become the same. As a result, the transport errors are corrected.

Application Example 10

In the printing apparatus, the tension-imparting section be disposed upstream of the transport section on a transport path on which the printing media are transported and have idler rollers that are passively rotated in conjunction with transport of the printing media. The tension-imparting section control individual controls respective tensile forces applied to the printing media by controlling respective rotational loads applied to the idler rollers.

According to this configuration, the tension-imparting section is disposed upstream of the transport section on the transport path on which printing media are transported. Thus, when the amount of slip in transport by the transport section (transport error) becomes different among a plurality of printing media as in the case described above, the tension-imparting section can correct the transport errors by imparting tensile forces that act on respective printing media in a direction opposite to the transporting forces applied by the transport section. In addition, the tension-imparting section includes the idler rollers that are passively rotated in conjunction with transport of the printing media. The tension-imparting section controls the respective tensile forces that are imparted individually onto a plurality of printing media by controlling the rotational loads applied to the idler rollers. The rotational load applied to each of the idler rollers can be easily provided as a sliding resistance, for example, by providing a sliding member that is in contact with the rotating member of the idler roller and pressing the sliding member against the rotating member. Thus, the tensile force imparted onto each of the printing media can be individually controlled in a simple and easy manner by controlling, for example, a pressing force or a pressing area of the sliding member.

Embodiments of the invention further control an amount of slip or correct transport errors based on at least one or more of the foregoing Application Examples.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
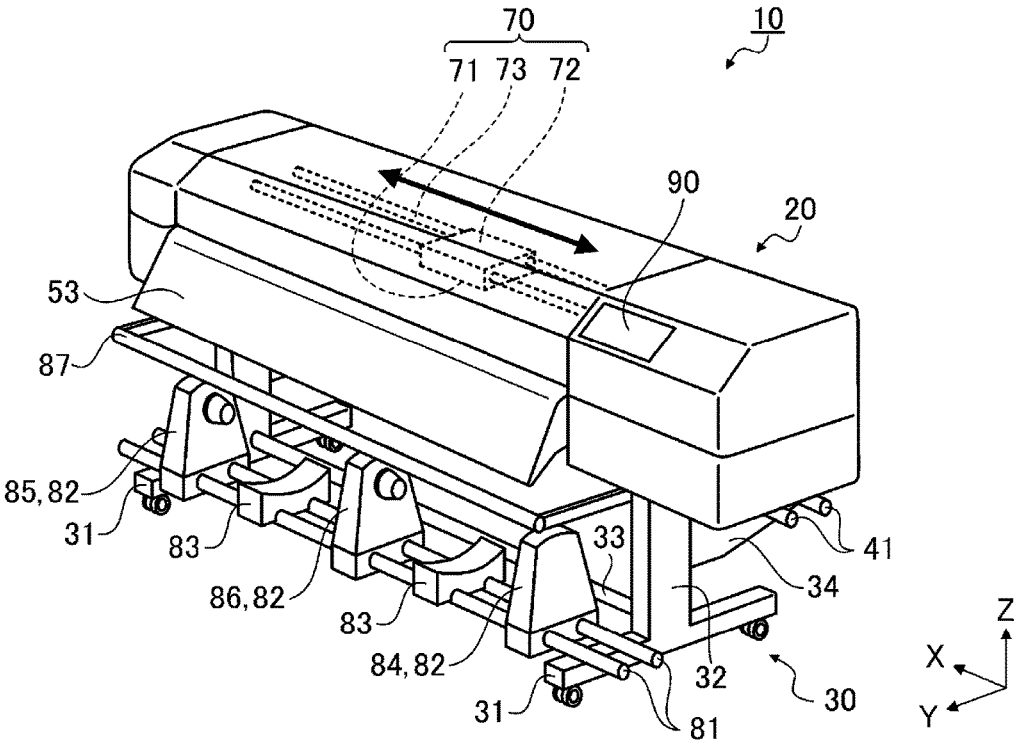
FIG. 1 is a perspective view illustrating an example configuration of a printing apparatus according to an embodiment.

Embodiments according to the invention will be described with reference to the drawings. Although one embodiment is described below, the invention is not limited to the embodiment presented. In the drawings, illustrations may not be drawn to actual scale for ease of understanding. In the X-Y-Z coordinate system shown in each of the drawings, the Z-axis direction represents the up-and-down direction, and the +Z direction represents the upward direction. The Y-axis direction represents the front-and-rear direction, and the +Y direction represents the frontward direction. The X-axis direction represents the right-and-left direction or the width direction, and the +X direction represents the rightward direction. The X-Y plane represents the horizontal plane. When two ends are present in the X-axis direction, one end on the side in the −X direction is denoted as "first end" and the other end on the side in the +X direction is denoted as "second end".

Embodiment 1

Figure 2:
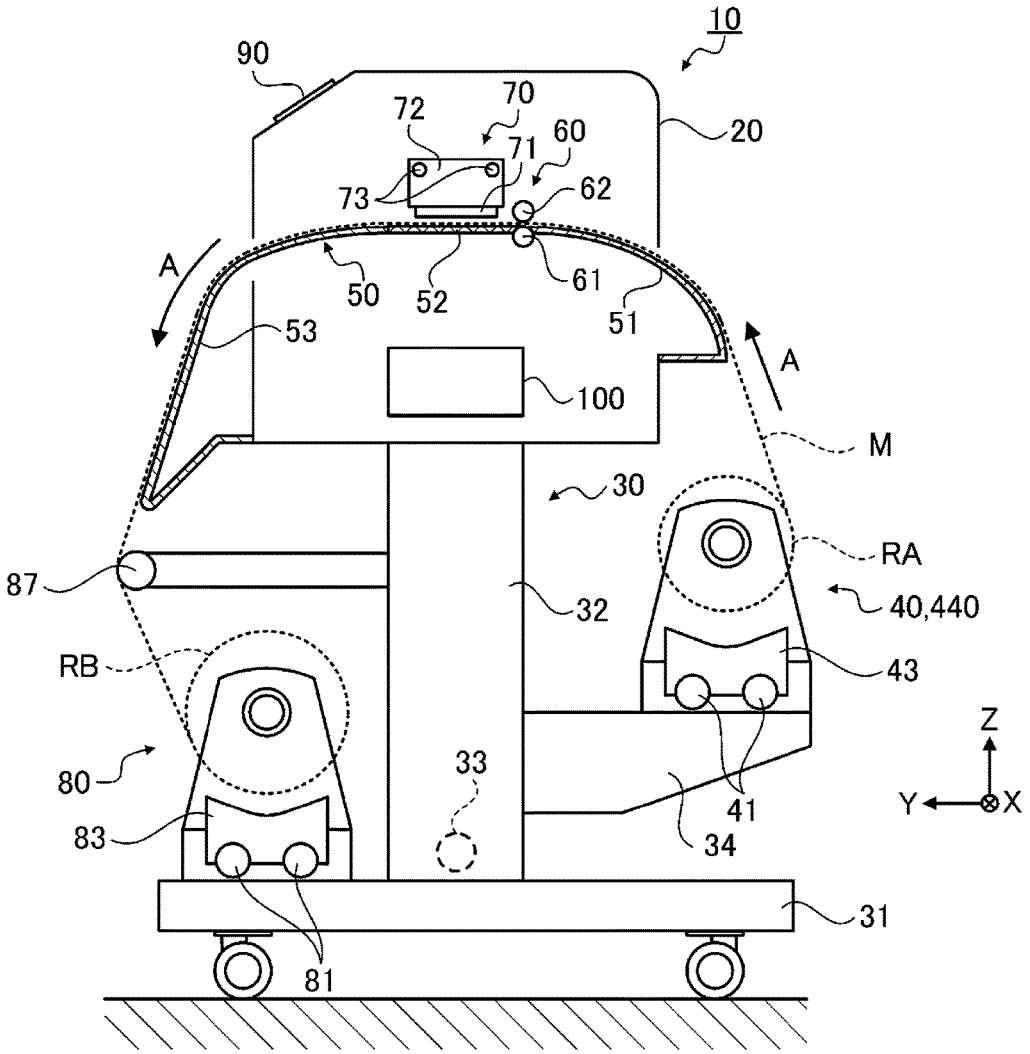
FIG. 2 is a cross-sectional side view illustrating the configuration of the printing apparatus of FIG. 1.

FIG. 1 is a perspective view illustrating an example configuration of a printing apparatus 10, and FIG. 2 is a cross-sectional side view of the printing apparatus 10. The printing apparatus 10 may be an ink jet printer that prints desired images onto a long roll-paper strip M that is supplied as a printing medium in a form of rolled paper (i.e., a roll). The printing apparatus 10 includes a housing 20 that is shaped like a box in one example and a housing support 30 that supports the housing 20.

As illustrated in FIG. 2, the printing apparatus 10 also includes, in a transport direction A of a roll-paper strip M, a supply section 40 for supplying a roll-paper strip M that is wound into a roll RA, a medium support section 50 for supporting the roll-paper strip M, a transport section 60 for transporting the roll-paper strip M by providing the roll-paper strip M with a transporting force, a printing section 70 for performing printing onto the roll-paper strip M, and a winding section 80 for winding the roll-paper strip M into a roll RB. The printing apparatus 10 further includes an operation unit 90 through which a user (e.g., an operator of the printing apparatus 10) operates the apparatus and a control unit 100 that integrally controls the printing apparatus 10.

As illustrated in FIGS. 1 and 2, the housing support 30 includes first leg portions 31 with their respective longitudinal directions being parallel to the Y-axis direction, second leg portions 32 extending upward from respective first leg portions 31, a connecting rod 33 that extends in the X-axis direction and connects the second leg portions 32 to each other, and extension portions 34 extending in the rearward direction from respective second leg portions 32. Two sets of the first leg portion 31 and the second leg portion 32 form a pair so as to face each other in the x-axis direction. The top ends of respective second leg portions 32, which are opposite to the bottom ends that are connected to the first leg portions 31, are connected to the housing 20.

Figure 3:
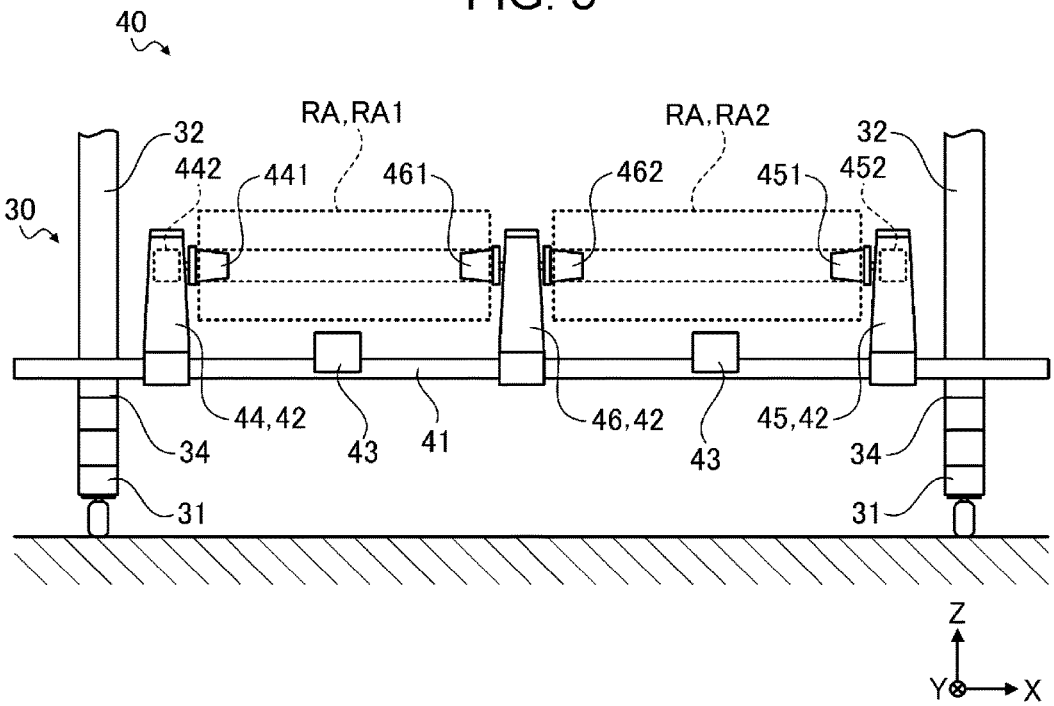
FIG. 3 is a rear view illustrating an example configuration of a supply section.

FIG. 3 is a rear view illustrating a configuration of a supply section 40 when the supply section 40 is viewed from behind the printing apparatus 10 (from the −Y side). As illustrated in FIG. 2 and FIG. 3, the supply section 40 is supported by the extension portions 34 of the housing support 30 in the housing 20 at a lower rear region. On a transport path on which a roll-paper strip M is transported, the supply section 40 is disposed at a position upstream of the transport section 60. The supply section 40 includes two guide rods 41, roll holding portions 42, and placement portions 43. The two guide rods 41 extend in the X-axis direction between the extension portions 34. The roll holding portions 42 rotatably hold a plurality of rolls RA (two rolls RA in the example in FIG. 3) into each of which a roll-paper strip M is cylindrically wound. The placement portions 43 are used for temporary placement of rolls RA when the rolls RA are replaced.

As illustrated in FIG. 3, the roll holding portions 42 include a first roll holder 44 disposed at the first end of the supply section 40 in the X-axis direction, a second roll holder 45 disposed at the second end of the supply section 40 in the X-axis direction, and an intermediate roll holder 46 detachably disposed between the first roll holder 44 and the second roll holder 45 in the X-axis direction. The first roll holder 44, the second roll holder 45, and the intermediate roll holder 46 are slidably supported by the guide rods 41. This allows media of different widths to be accommodated.

The first roll holder 44 has a first rotator 441, a first motor 442, and a fixation screw (not shown). The first rotator 441 engages the first end of a roll RA and can rotate together with the roll RA. The first motor 442 rotationally drives the first rotator 441. The fixation screw allows or does not allow the first roll holder 44 to move in the X-axis direction along the guide rods 41. In addition, the second roll holder 45 has a second rotator 451, a second motor 452, and a fixation screw (not shown). The second rotator 451 engages the second end of a roll RA and can rotate together with the roll RA. The second motor 452 rotationally drives the second rotator 451. The fixation screw allows or does not allow the second roll holder 45 to move in the X-axis direction along the guide rods 41.

In one embodiment, the first motor 442 and the second motor 452 are examples of rotational drive devices that rotationally drive the rolls RA in the supply section 40. The first motor 442 and the second motor 452 may drive the first rotator 441 and the second rotator 451 via respective reduction gears. The first motor 442 and the second motor 452 can be controlled independently.

The intermediate roll holder 46 has a first intermediate rotator 461 and a second intermediate rotator 462. The first intermediate rotator 461 engages the second end of the roll RA of which the first end engages the first rotator 441 and can rotate together with the roll RA. The second intermediate rotator 462 engages the first end of the roll RA of which the second end engages the second rotator 451 and can rotate together with the roll RA. The intermediate roll holder 46 also has a fixation screw (not shown) that allows or does not allow the intermediate roll holder 46 to move in the X-axis direction along the guide rods 41.

The first intermediate rotator 461 and the second intermediate rotator 462 of the intermediate roll holder 46 are rotated only passively in one example, whereas the first rotator 441 of the first roll holder 44 and the second rotator 451 of the second roll holder 45 actively drive the rolls RA. In addition, the first intermediate rotator 461 and the second intermediate rotator 462 are formed so as to be able to rotate at different rotational speeds.

Note that the first rotator 441, the second rotator 451, the first intermediate rotator 461, and the second intermediate rotator 462 are inserted (engaged) into the ends of core tubes (for example, paper tubes) of rolls RA and rotate together with the rolls RA. For this reason, the first rotator 441, the second rotator 451, the first intermediate rotator 461, and the second intermediate rotator 462 are formed such that each of the rotators tapers from the base portion thereof to the tip and is shaped substantially like a truncated cone. The first and second intermediate rotators 461 and 462 can rotate independently of each other.

In one embodiment, the intermediate roll holder 46 is detachably mounted in the supply section 40. In the case that the intermediate roll holder 46 is not mounted in the supply section 40, the first rotator 441 of the first roll holder 44 and the second rotator 451 of the second roll holder 45 engage respective ends of a roll RA. In this case, the supply section 40 rotates one roll RA and supplies one roll-paper strip M that is wound around the roll RA. In this case, either one or both of the first motor 442 and the second motor 452 could be used to rotate the one roll RA.

In the case that the intermediate roll holder 46 is provided in the supply section 40, the first rotator 441 of the first roll holder 44 and the first intermediate rotator 461 of the intermediate roll holder 46 engage respective ends of one roll RA, whereas the second rotator 451 of the second roll holder 45 and the second intermediate rotator 462 of the intermediate roll holder 46 engage respective ends of the other roll RA. In this case, the supply section 40 rotates the one roll RA and the other roll RA and supplies two roll-paper strips M that are wound around the one roll RA and the other roll RA, respectively.

Note that in the following description, the one roll RA and the other roll RA described above may be referred to as "roll RA1" and "roll RA2", respectively, or first roll and second roll. In addition, a roll-paper strip M supplied from the roll RA1 may be referred to as "roll-paper strip M1" or M1 and a roll-paper strip M supplied from the roll RA2 may be referred to as "roll-paper strip M2" or M2.

As illustrated in FIG. 2, the medium support section 50 includes a first medium support 51 formed so as to extend from a lower region behind the housing 20 to the inside of the housing 20, a second medium support 52 formed so as to extend in the forward direction within the housing 20, and a third medium support 53 formed so as to extend from the housing 20 toward a lower region in front of the housing 20. The medium support section 50 thus forms a transport path that guides a roll-paper strip M supplied from the supply section 40 toward the winding section 80 while supporting the roll-paper strip M. Depending on a printing method that the printing apparatus 10 employs, the medium support section 50 may include a heater therein for heating a roll-paper strip M if the roll-paper strip M requires heating before or after printing.

As illustrated in FIG. 2, the transport section 60 includes a drive roller 61 that rotates while in contact with the bottom side of a roll-paper strip M and an idler roller 62 that rotates while in contact with the top side of the roll-paper strip M. While the drive roller 61 and the idler roller 62 nip the roll-paper strip M, the transport section 60 provides the roll-paper strip M with a transporting force by driving the drive roller 61. In this manner, the roll-paper strip M that is supplied from the supply section 40 is transported in the transport direction A. In the following description, the transport of a predetermined amount of a roll-paper strip M by the transport section 60 in the transport direction A may be referred to as "transport action". During the transport action, supply of a roll-paper strip M by the supply section 40 and winding up of the roll-paper strip M by the winding section 80 are carried out substantially simultaneously.

As illustrated in FIG. 2, the printing section 70 includes a printing head 71 that ejects ink, a carriage 72 that holds (or onto which is mounted) a printing head 71, and guide shafts 73 that extend in the X-axis direction to support the carriage 72. The printing section 70 performs an ejection action to print one scanning portion (or one pass portion) in such a manner that the printing head 71 ejects ink onto a roll-paper strip M while the carriage 72 moves in the X-axis direction, which is the direction in which the guide shafts 73 extend.

Figure 4:
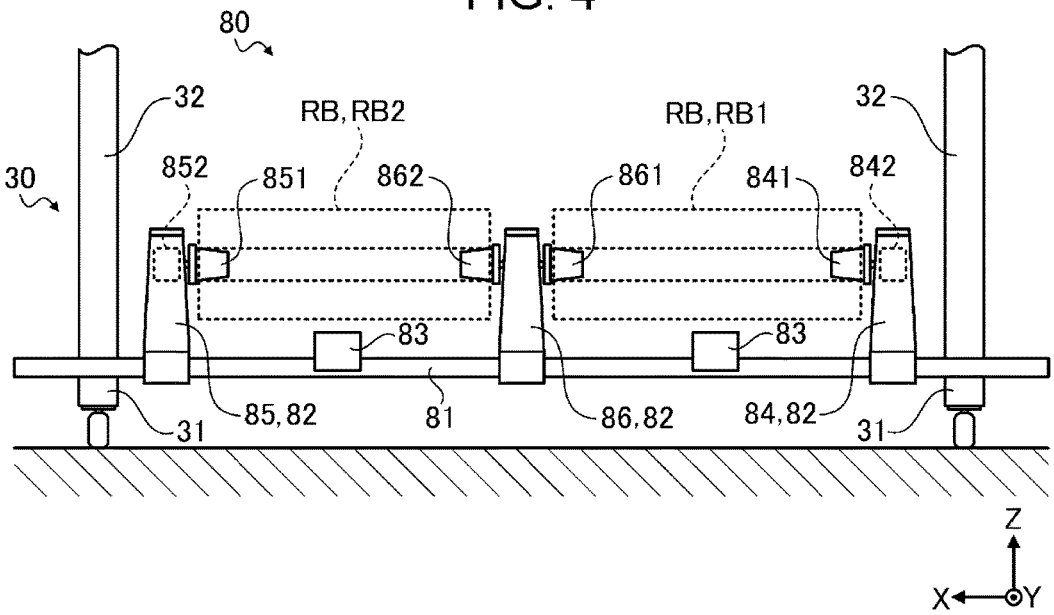
FIG. 4 is a front view illustrating an example configuration of a winding section.

FIG. 4 is a front view illustrating a configuration of the winding section 80 when the winding section 80 is viewed from in front of the printing apparatus 10 (from the +Y side). As illustrated in FIG. 2 and FIG. 4, the winding section 80 is supported by the first leg portions 31 of the housing support 30 at a position in front of the second leg portions 32. The winding section 80 includes two guide rods 81, roll holding portions 82, and placement portions 83. The two guide rods 81 extend in the X-axis direction between the first leg portions 31. The roll holding portions 82 rotatably hold rolls RB into or onto each of which a roll-paper strip M is cylindrically wound. The placement portions 83 are used for temporary placement of rolls RB when the rolls RB are replaced or removed.

The roll holding portions 82 include a first roll holder 84 disposed at the first end of the winding section 80 in the X-axis direction, a second roll holder 85 disposed at the second end of the winding section 80 in the X-axis direction, and an intermediate roll holder 86 detachably disposed between the first roll holder 84 and the second roll holder 85 in the X-axis direction. The first roll holder 84, the second roll holder 85, and the intermediate roll holder 86 are slidably supported by the guide rods 81.

The first roll holder 84 has a first rotator 841, a first motor 842, and a fixation screw (not shown). The first rotator 841 engages the first end of a roll RB and can rotate together with the roll RB. The first motor 842 rotationally drives the first rotator 841. The fixation screw allows or does not allow the first roll holder 84 to move in the X-axis direction along the guide rods 81. In addition, the second roll holder 85 has a second rotator 851, a second motor 852, and a fixation screw (not shown). The second rotator 851 engages the second end of a roll RB and can rotate together with the roll RB. The second motor 852 rotationally drives the second rotator 851. The fixation screw allows or does not allow the second roll holder 85 to move in the X-axis direction along the guide rods 81. The first motor 842 and the second motor 852 can be controlled independently or in conjunction in the manner in which the first and second motors 442 and 452 are driven.

The intermediate roll holder 86 has a first intermediate rotator 861 and a second intermediate rotator 862, which can rotate independently. The first intermediate rotator 861 engages the second end of the roll RB of which the first end engages the first rotator 841 and can rotate together with the roll RB. The second intermediate rotator 862 engages the first end of the roll RB of which the second end engages the second rotator 851 and can rotate together with the roll RB. The intermediate roll holder 86 also has a fixation screw (not shown) that allows or does not allow the intermediate roll holder 86 to move in the X-axis direction along the guide rods 81.

The first intermediate rotator 861 and the second intermediate rotator 862 of the intermediate roll holder 86 are only passively rotated, whereas the first rotator 841 of the first roll holder 84 and the second rotator 851 of the second roll holder 85 actively drive the rolls RB. In addition, the first intermediate rotator 861 and the second intermediate rotator 862 are formed so as to be able to rotate at different rotational speeds.

Note that the first rotator 841, the second rotator 851, the first intermediate rotator 861, and the second intermediate rotator 862 are inserted (engaged) into the ends of core tubes (for example, paper tubes) of rolls RB and rotate together with the rolls RB. For this purpose, the first rotator 841, the second rotator 851, the first intermediate rotator 861, and the second intermediate rotator 862 are formed such that each of the rotators tapers from the base portion thereof to the tip and are shaped substantially like truncated cones.

In the embodiment, the intermediate roll holder 86 is detachably mounted in the winding section 80. In the case that the intermediate roll holder 86 is not mounted in the winding section 80, the first rotator 841 of the first roll holder 84 and the second rotator 851 of the second roll holder 85 engage respective ends of a roll RB. In this case, the winding section 80 rotates one roll RB and winds one roll-paper strip M into the roll RB. In this case, one or both of the first and second motors 842 and 852 may be used to rotate the roll RB.

In the case that the intermediate roll holder 86 is provided in the winding section 80, the first rotator 841 of the first roll holder 84 and the first intermediate rotator 861 of the intermediate roll holder 86 engage respective ends of one roll RB, whereas the second rotator 851 of the second roll holder 85 and the second intermediate rotator 862 of the intermediate roll holder 86 engage respective ends of another roll RB. In this case, the winding section 80 rotates the one roll RB and the other roll RB and winds two roll-paper strips M into the one roll RB and the other roll RB, respectively.

Note that in the following description, the one roll RB and the other roll RB described above may be referred to as "roll RB1" and "roll RB2", respectively, or first roll RB and second roll RB. In other words, a roll-paper strip M1 is wound into the roll RB1, and a roll-paper strip M2 is wound into the roll RB2.

In one embodiment, when more than two rolls are mounted, some of the intermediate rotators in both the supply section and the winding section may include driven motors. For example, an intermediate rotator may include an actively driven rotator and a passive rotator.

As illustrated in FIG. 1 and FIG. 2, the winding section 80 may also include a guide bar 87 that guides a roll-paper strip M on the transport path while the roll-paper strip M is wound into the roll RB. The guide bar 87 extends in the X-axis direction so as to support the roll-paper strip M across the width thereof. Moreover, as illustrated in FIG. 1 and FIG. 2, the operation unit 90 is disposed on the top surface of the printing apparatus 10. The operation unit 90 enables a user to change settings for the printing apparatus 10 or to instruct the printing apparatus 10 to execute printing. Thus, the operation unit 90 may be configured to include, for example, a plurality of buttons and a display such as a liquid crystal display. In one embodiment, the operation unit 90 is an example of an input section.

The control unit 100 is a so-called microcomputer or controller that includes a CPU, storage media (i.e., memory, such as ROM and RAM), and so forth. In accordance with an entered print job, the control unit 100 performs printing on a roll-paper strip M (or multiple strips) by, for example, controlling components of the printing apparatus 10 so as to cause the components to perform transport actions and ejection actions alternately or as appropriate.

In one embodiment, when printing is performed on two roll-paper strips M1 and M2 in parallel, the transport section 60 performs transport actions equally on two roll-paper strips M1 and M2. When printing is performed on two roll-paper strips M1 and M2 in parallel, ejection actions are performed such that the carriage 72 moves across the two roll-paper strips M1 and M2 in the width direction (X-axis direction) and the printing head 71 mounted on the carriage 72 ejects ink onto the two roll-paper strips M1 and M2. In other words, the transport section 60 has common transport rollers (the drive roller 61 and the idler roller 62) that transport a plurality of roll-paper strips M (roll-paper strips M1 and M2) in parallel, and the printing section 70 has the common printing head 71 that performs printing onto a plurality of the roll-paper strips M. Thus, the same printing head is used for all roll-paper strips and the same transport section transports all of the roll-paper strips.

Figure 5:
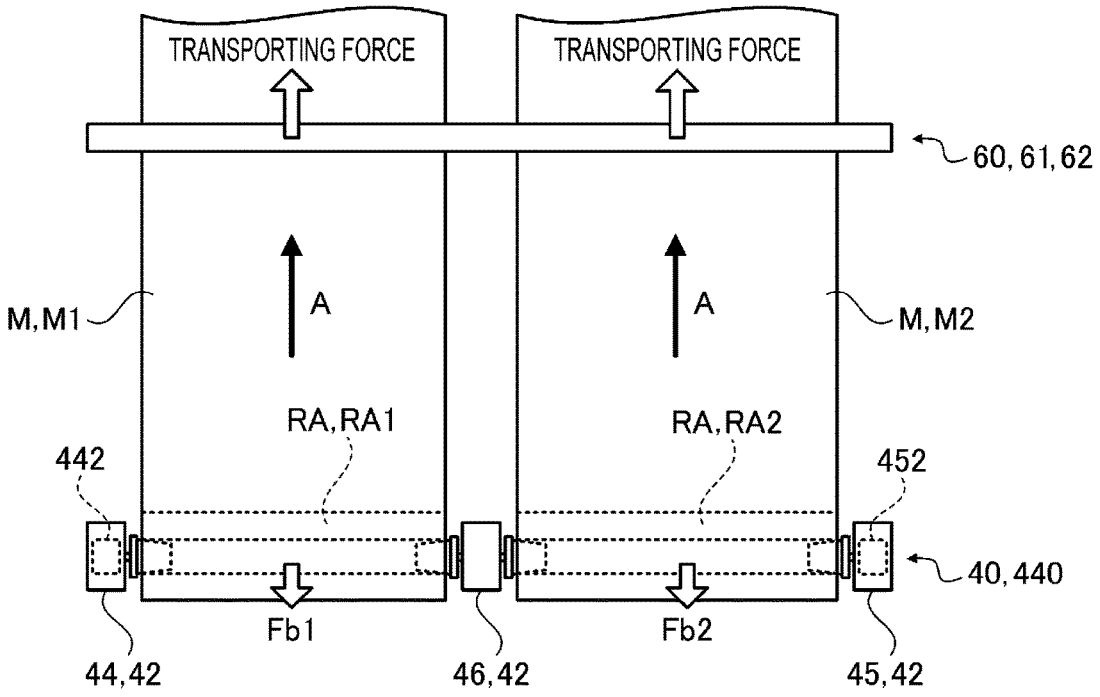
FIG. 5 is a view schematically illustrating an example of how a roll-paper strip supplied from the supply section is transported by a transport section.

FIG. 5 is a view schematically illustrating how two roll-paper strips M1 and M2 supplied from the supply section 40 are transported by the transport section 60 in the transport direction A. When printing is performed on two roll-paper strips M1 and M2 in parallel, the transport section 60, which includes the drive roller 61 and the idler roller 62, operates similarly on the two roll-paper strips M1 and M2. However, transporting rates (i.e., feed rates) of two roll-paper strips M1 and M2 may become different. For example, the feed rates may depend, by way of example, on specifications of the two roll-paper strips M1 and M2 and on remaining amounts of the rolls RA1 and RA2. More specifically, the roll-paper strips M1 and M2 may have different widths, different surface characteristics (i.e., different coefficients of friction), and different thicknesses. Even if roll-paper strips M1 and M2 are of the same type, remaining amounts of the rolls RA1 and RA2 (moments of inertia) may be different. In these cases, amounts of slip occurring between the drive roller 61 and respective roll-paper strips M1 and M2 become or are slightly different. This leads to a difference in the amount of slip in transport by the transport section 60 (i.e., transport error). Consequently, this may further lead to a difference in the quality of printed images between the two roll-paper strips M or may lead to an inability to print the best-quality images on each of the roll-paper strips M.

However, the printing apparatus 10 according to one embodiment includes a tension-imparting section 440 that imparts a tensile force to a roll-paper strip M against the transporting force provided by the transport section 60. Moreover, the tension-imparting section 440 imparts respective tensile forces individually to a plurality of roll-paper strips M (i.e., the roll-paper strips M1 and M2). The tensile forces provided by the tension-imparting section 440 adjust the above-described transport errors. In other words, the tensile forces provided to the strip M1, if any, may differ from the tensile forces provided to the strip M2, if any. These points will be described more specifically below.

In one embodiment, the tension-imparting section 440 is configured to include the first motor 442 and the second motor 452, which are rotational drive devices that rotationally drive rolls RA in the supply section 40. The rotational drive devices are controlled by the control unit 100 (see FIG. 2). The first motor 442 and the second motor 452 are motors that rotationally drive the first roll holder 44 and the second roll holder 45 that rotatably hold rolls RA1 and RA2 in the supply section 40, respectively. The first motor 442 and the second motor 452 cause the rolls RA1 and RA2 to supply roll-paper strips M1 and M2 and also increase/decrease supply loads when the roll-paper strips M1 and M2 are supplied. By increasing the supply loads, tensile forces applied to the roll-paper strips M1 and M2 are increased against transporting forces acting on the roll-paper strips M1 and M2. By decreasing the supply loads, tensile forces applied to the roll-paper strips M1 and M2 are decreased against transporting force acting on the roll-paper strips M1 and M2.

The control unit 100 controls electric currents supplied to the first motor 442 and the second motor 452 so as to control the driving torques thereof and control the increase/decrease of the supply loads. The control unit 100 performs this electric current control separately for the first motor 442 and the second motor 452 so that a predetermined amount of tensile force is applied separately to each of the roll-paper strips M1 and M2 that are pulled by the transport section 60.

The predetermined tensile force, which is applied individually to each of the roll-paper strips M1 and M2 (Fb1 and Fb2 in FIG. 5), is a tensile force (i.e., back tension) that has a preset amount that causes the amount of slip of each of the roll-paper strips M1 and M2 at transport section 60 to become equal or similar to a predetermined slip amount or that eliminates slip. In the printing apparatus 10, such preset tensile forces are stored in advance as a data table in a memory included in the control unit 100. During printing, the control unit 100 refers to the data table and causes the tension-imparting section 440 to apply an appropriate tensile force.

In preparation of the data table, each type of roll-paper strip M that the printing apparatus 10 may use is sufficiently evaluated in advance. More specifically, the same transport action is performed on different types of roll-paper strips M while applying a constant tensile force (back tension) thereto. Subsequently, the actual length that has been transported is measured for each of the roll-paper strips M and compared to a transporting rate that has been set in advance. For example, a scale image (for example, graduated in 1 mm increments) is printed on a roll-paper strip M while applying a constant back tension to the roll-paper strip M (i.e., a back tension common to roll-paper strips M). The constant back tension is set to such a level that wrinkles are not likely to be generated while transported on the transport path. Subsequently, the actual printed scale image (for example, an amount of 500 mm on the scale) is measured. The amount of slip is calculated from the difference between the printed scale image and the measurement results. The amount of tensile force (back tension) is determined for each type of roll-paper strip M in such a manner that with determined tensile forces, all the slip amounts of the roll-paper strips M that may be used become equal or similar to each other on the basis of the slip amount of the roll-paper strip M that has exhibited the largest amount of slip. The data table is a table listing tensile forces (back tensions) determined as such for types of roll-paper strips M. Note that the types of roll-paper strips M are types into which roll-paper strips M are classified, for example, by product-type numbers, materials, and product dimensions, such as thickness and width.

In addition, even if the roll-paper strips M are of the same type, the amount of slip may become different depending on the remaining amounts of the rolls RA1 and RA2. By conducting similar evaluations in advance, correction values (or resultant amounts of tensile force, i.e., back tension, based on the correction values) corresponding to the remaining amounts of the rolls RA1 and RA2 are determined and included in the data table.

When conducting printing, a user (operator) of the printing apparatus 10 specifies a type of roll-paper strip M via the operation unit 90 (see FIGS. 1 and 2), in other words, via the input section. The control unit 100 obtains the amount of tensile force from the data table that corresponds to the type of roll-paper strip M specified by the user and applies the tensile force obtained from the data table for control. In other words, the amount of tensile force that is set according to the type of roll-paper strip M is imparted individually to the corresponding roll-paper strip M by the tension-imparting section 440. When corrections according to the remaining amounts of the rolls RA1 and RA2 are necessary, the control unit 100 can identify the remaining amounts of the rolls RA1 and RA2 on the basis of the amounts of printing that have been executed, and thus the control unit 100 individually applies an appropriately corrected amount of tensile force to the corresponding roll-paper strip M.

With the printing apparatus according to one embodiment, the following advantageous effects can be obtained. The printing apparatus 10 according to the embodiment includes the supply section 40, the transport section 60, and the printing section 70. The supply section 40 supports a plurality of rolls RA around which roll-paper strips M are wound and supplies the roll-paper strips M. The transport section 60 applies transporting forces to the supplied roll-paper strips M and transports the roll-paper strips M. The printing section 70 performs printing onto the transported roll-paper strips M. In short, the printing apparatus 10 according to the embodiment can perform printing in parallel on a plurality of roll-paper strips M supplied from rolls RA. In addition, the printing apparatus 10 includes the rotational drive devices (the first motor 442 and the second motor 452) that serve as the tension-imparting section 440 that imparts respective tensile forces individually to a plurality of roll-paper strips M against the transporting forces acting on the roll-paper strips M. Thus, in the case that the transporting rate (feed rate) under a predetermined transporting force may become different depending on a transported roll-paper strip M, the difference in the transporting rate (feed rate) can be corrected by imparting a tensile force, which acts against the transporting force, individually to the roll-paper strip M. As a result, the transport accuracy for a plurality of roll-paper strips M can be further improved, and differences in the quality of printed images can be suppressed. By imparting individualized tensile forces to the multiple roll-paper strips, the transport rate of the multiple roll-paper strips can be essentially equalized notwithstanding the different media characteristics.

Moreover, the transport section 60 has common transport rollers (the drive roller 61 and the idler roller 62) that transport a plurality of roll-paper strips M in parallel, and the printing section 70 has the common printing head 71 that performs printing onto a plurality of the roll-paper strips M. In other words, the printing apparatus 10 that can perform printing in parallel on a plurality of roll-paper strips M supplied from rolls RA can be constructed with a simple mechanism. As described above, the printing apparatus 10 includes the tension-imparting section 440 that imparts respective tensile forces individually to a plurality of roll-paper strips M against transporting forces acting on the roll-paper strips M. Thus, even with such a simple mechanism, the printing apparatus 10 can suppress deterioration in the transport accuracy for a plurality of roll-paper strips M, thereby enabling higher quality printing.

The tension-imparting section 440 imparts amounts of tensile force that are set according to types of roll-paper strips M individually to corresponding roll-paper strips M. This enables appropriate correction when amounts of slip in transport by the transport section 60 become different between the types of roll-paper strips M (e.g., due to difference in material, width, etc.).

Moreover, the tension-imparting section 440 has the rotational drive devices (first motor 442, second motor 452) that rotationally drive rolls RA in the supply section 40. The tension-imparting section 440 controls respective tensile forces applied individually to a plurality of roll-paper strips M by controlling driving torques for driving the rotational drive devices. In other words, in the supply section 40, the tension-imparting section 440 causes the rotational drive devices to supply roll-paper strips M to the printing section 70 (or to increase/decrease the supply loads). While doing so, the tension-imparting section 440 controls driving torques that drive the rotational drive devices and thereby controls respective tensile forces that are individually applied to a plurality of roll-paper strips M. According to this configuration, the tension-imparting section 440 can be formed as part of the function of the supply section 40. In other words, the tension-imparting section 440 can be formed by using a function of the supply section 40. The tension-imparting section can be integrated into the supply section 40. Consequently, the printing apparatus 10 that can perform printing on a plurality of roll-paper strips M in parallel can be constructed efficiently while enabling higher quality printing.

In addition, the tension-imparting section 440 (first motor 442, second motor 452) is disposed upstream of the transport section 60 on the transport path on which roll-paper strips M are transported. Thus, the tension-imparting section 440 can impart tensile forces that act on the roll-paper strips M in a direction opposite to the transporting forces applied by the transport section 60. In other words, when the transport section 60 transports a plurality of roll-paper strips M and the amounts of slip (transport errors) of the transport section 60 become different between the roll-paper strips M, tensile forces acting in the direction opposite to the transporting forces are imparted to respective (e.g., one or more) roll-paper strips M in such a manner that the amounts of slip in transport by the transport section 60 (transport errors) become the same, thereby correcting the transport errors.

Note that embodiments of the invention are not limited to the embodiment described above, and various modifications and alternations can be added to the embodiment. Modification examples will be described below. Like numerals will be used for elements similar to those of the above embodiment, thereby duplicated description will be omitted.

Modification Example 1

In one embodiment, when conducting printing, a user (operator) of the printing apparatus 10 specifies a type of roll-paper strip M via the input section (operation unit 90). The control unit 100 obtains the amount of tensile force from the data table that corresponds to the type of roll-paper strip M specified by the user and applies the obtained tensile force for control. However, the printing apparatus 10 is not limited to such a configuration or a method. For example, the printing apparatus 10 may include a section for recognizing the type of roll-paper strip M, and the tension-imparting section 440 may individually impart a predetermined amount of tensile force according to the recognized type of roll-paper strip M to the corresponding roll-paper strip M.

Figure 6:
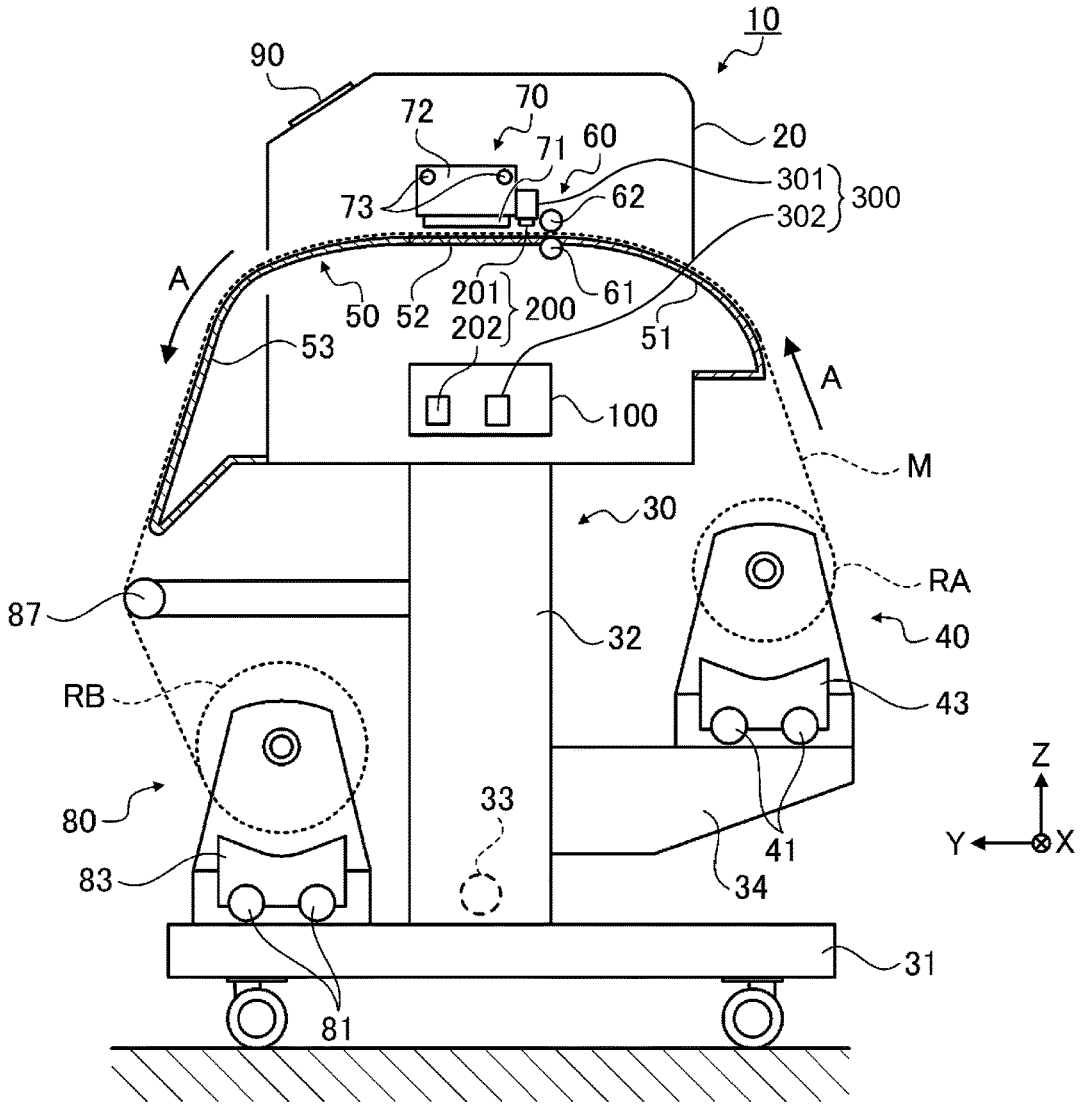
FIG. 6 is a cross-sectional side view illustrating an example configuration of a printing apparatus according.

FIG. 6 is a cross-sectional side view illustrating an example configuration of a printing apparatus 10. A printing apparatus 10 according to the present modification example includes a medium recognition section 200 in addition to the printing apparatus 10. The medium recognition section 200 includes, for example, an imaging device 201 that images the surface profile of a transported roll-paper strip M and an image processing portion 202 that can recognize and process images taken by the imaging device 201. The imaging device 201 is disposed on the rear side surface of the carriage 72 (on the −Y side surface of the carriage 72) and can image the surface profile of a roll-paper strip M that is transported to a position where the second medium support 52 supports the roll-paper strip M on the transport path. The imaging device 201 moves together with the carriage 72 in the X-axis direction. When a plurality of roll-paper strips M are installed, the imaging device 201 recognizes the width of each roll-paper strip M while recognizing the widthwise ends thereof and images the surface of each roll-paper strip M and transmits the images to the control unit 100.

The image processing portion 202 is included in the control unit 100 as a function portion (i.e., as software) of the control unit 100. The image processing portion 202 is capable of recognizing images received and determining a type of texture of a roll-paper strip M (or a type of constituting material) through image processing. The texture type of roll-paper strip M can be determined (recognized), for example, by matching the acquired images with stored surface images of a plurality of roll-paper strips M that have been entered in advance (e.g., comparison of degree of irregularity). In addition, the control unit 100 includes a data table containing appropriate values of tensile force (i.e., back tension) that are used to control the tension-imparting section 440. The values of tensile force are classified into types of roll-paper strips M in accordance with texture types and widths.

In printing, the control unit 100 controllably drives the carriage 72 and the imaging device 201 so as to recognize (identify) the texture type and width of roll-paper strip M used. The control unit 100 obtains an amount of tensile force from the data table that corresponds to a recognized type of roll-paper strip M and applies the obtained tensile force for control. In short, the printing apparatus according to the present modification example includes the medium recognition section 200 that recognizes the type of roll-paper strip M. The tension-imparting section 440 individually imparts a predetermined amount of tensile force according to the recognized type of roll-paper strip M to the corresponding roll-paper strip M.

The printing apparatus according to the present modification example includes the medium recognition section 200 that recognizes the type of roll-paper strip M, and the medium recognition section 200 includes the imaging device 201 that images the surface profile of a transported roll-paper strip M and the image processing portion 202 that can recognize and process the images taken by the imaging device 201. This eliminates the necessity of entering the type (including width type) of roll-paper strip M in the printing apparatus 10 every time a roll-paper strip M is replaced. Moreover, the tension-imparting section 440 individually imparts a predetermined amount of tensile force according to the recognized type of roll-paper strip M to the corresponding roll-paper strip M. This enables appropriate correction when the amount of slip in transport by the transport section 60 becomes different depending on the type of roll-paper strip M (difference in material, width, etc.). The medium recognition system 200 can be configured to evaluate the roll-media each time a roll RA is replaced, periodically, at the beginning of printing, or the like or combination thereof.

Modification Example 2

A printing apparatus 10 according to the modification example 2 includes a width detecting section 300 for detecting the widths of installed roll-paper strips M in addition to the printing apparatus 10. The printing apparatus 10 according to the present modification example is suitable when a limited number of texture types of the roll-paper strips M is used. In other words, the width detecting section is useful at least when the roll-paper strip M is mostly replaced with a different width type while the texture type of the roll-paper strip M is not changed often.

The width detecting section 300 includes a light-emitting/receiving device 301 that emits light to the roll-paper strips M transported on the transport path and receives reflected light of the light that has been emitted. The width detecting section 300 also includes a detection processing portion 302 that processes results (photodetection signal) from the reflected light that is received. The light-emitting/receiving device 301 is disposed at a position where the imaging device 201 according to the modification example 1 is installed (on the rear side surface of the carriage 72 (on the −Y side surface of the carriage 72) (see FIG. 6)). The light-emitting/receiving device 301 transmits a photodetection signal to the control unit 100. The detection processing portion 302 is included in the control unit 100 as a function (i.e., as a software program) of the control unit 100. The detection processing portion 302 is capable of detecting the widths of roll-paper strips M by analyzing the photodetection signal coming from the light-emitting/receiving device 301 in association with the movement of the carriage 72. In other words, the width detecting section 300 can recognize the width of each of the installed roll-paper strips M by scanning, in the width direction, the roll-paper strips M that are transported on the transport path.

The control unit 100 includes a data table (in other words, a condition table for a roll-paper strip M to be printed on) containing appropriate values of tensile force (i.e., back tension) that are applied according to the widths of roll-paper strips M and that are used to control the tension-imparting section 440. The control unit 100 obtains the amounts of tensile force from the data table that correspond to detected widths of roll-paper strips M and applies the obtained tensile forces for control. In short, the printing apparatus according to the present modification example includes the width detecting section 300 that recognizes the widths of roll-paper strips M. The tension-imparting section 440 individually imparts respective amounts of tensile force that are set according to the detected widths of roll-paper strips M to the corresponding roll-paper strips M.

The printing apparatus according to the present modification example includes the width detecting section 300 that detects the widths of roll-paper strips M. Consequently, this eliminates the necessity of entering the width information of a roll-paper strip M into the printing apparatus 10 every time the width of a roll-paper strip M is replaced. Moreover, the tension-imparting section 440 individually imparts respective amounts of tensile force that are set according to the detected widths of roll-paper strips M to the corresponding roll-paper strips M. Thus, in the case that, for example, the printing apparatus 10 performs printing on a plurality of roll-paper strips M in parallel but uses a limited number of texture types of roll-paper strips M, appropriate correction is performed when the amounts of slip in transport by the transport section 60 become different depending on the widths of roll-paper strips M.

Modification Example 3

In the embodiments described above, a data table in which the amounts of tensile force to be imparted are correlated to types of roll-paper strips M is prepared on the basis of advance evaluation in order that tensile forces (back tensions) suitable for specific types of roll-paper strips M are imparted so as to correct the transport errors. In addition, in one embodiment, when conducting printing, a user (operator) of the printing apparatus 10 specifies the type of roll-paper strip M via the input section (operation unit 90) so that the corresponding tensile force is appropriately selected from the data table. However, the type of roll-paper strip M to be used may be unknown, or the data table prepared in advance may not contain data corresponding to the roll-paper strip M.

This modification example provides a configuration in which an appropriate tensile force for correcting a transport error can be set by evaluating the transport characteristic of a roll-paper strip M to be printed on and by manually entering the evaluation results. In other words, the printing apparatus according to the present modification example includes the operation unit 90, which serves as the input section into which the transport characteristic of a roll-paper strip M is entered. The tension-imparting section 440 individually imparts a predetermined amount of tensile force according to the entered transport characteristic to the corresponding roll-paper strip M. This point will be described more specifically below.

The printing apparatus 10 according to the present modification example stores a function that can be used for calculations in the control unit 100. The function expresses the relationship between the amount of slip and the amount of tensile force to correct transport errors resulting from respective amounts of slip. The relationship is obtained from evaluations that are similar to that described in herein (measurement of the actual transported length of each roll-paper strip M under the transporting rate set in advance). The evaluations are conducted on various types of roll-paper strips M. In short, the function, which expresses the relationship between the amount of slip and the amount of tensile force required to correct the transport error resulting from the amount of slip, is obtained in advance on the basis of a sufficient number of evaluations. The obtained function is stored in the memory included in the control unit 100.

The printing apparatus 10 is equipped with a utility software program that can perform evaluation similar to that described in one embodiment. More specifically, the utility software program is, for example, a program that prints an image that contains a scale (for example, a scale image graduated in 1 mm) on a roll-paper strip M while applying a constant back tension. A user (operator) actually measures the printed scale image (for example, a nominal length of 500 mm) and can calculate the amount of slip from the difference between the nominal length and the measured length.

The user (operator) launches or causes this program to be executed by manipulating the operation unit 90 and obtains evaluation results. The user subsequently enter the evaluation results, in other words, the transport characteristic (i.e., amount of slip) in the operation unit 90. The control unit 100 can calculate the tensile force suitable for the corresponding roll-paper strip M by using the above function.

According to the present modification example, the printing apparatus 10 includes the operation unit 90, which serves as the input section into which the transport characteristic of a roll-paper strip M is entered. The transport characteristic, such as an amount of slip (transport error), is evaluated in advance for each type of roll-paper strip M. The operation unit 90 enables the printing apparatus 10 to recognize the transport characteristic (i.e., the amount of slip). The tension-imparting section 440 individually imparts the amount of tensile force that is set according to the entered transport characteristic of a roll-paper strip M to the corresponding roll-paper strip M. This enables appropriate correction when the transport characteristic in transport by the transport section 60 becomes different depending on the roll-paper strip M.

Modification Example 4

Figure 7:
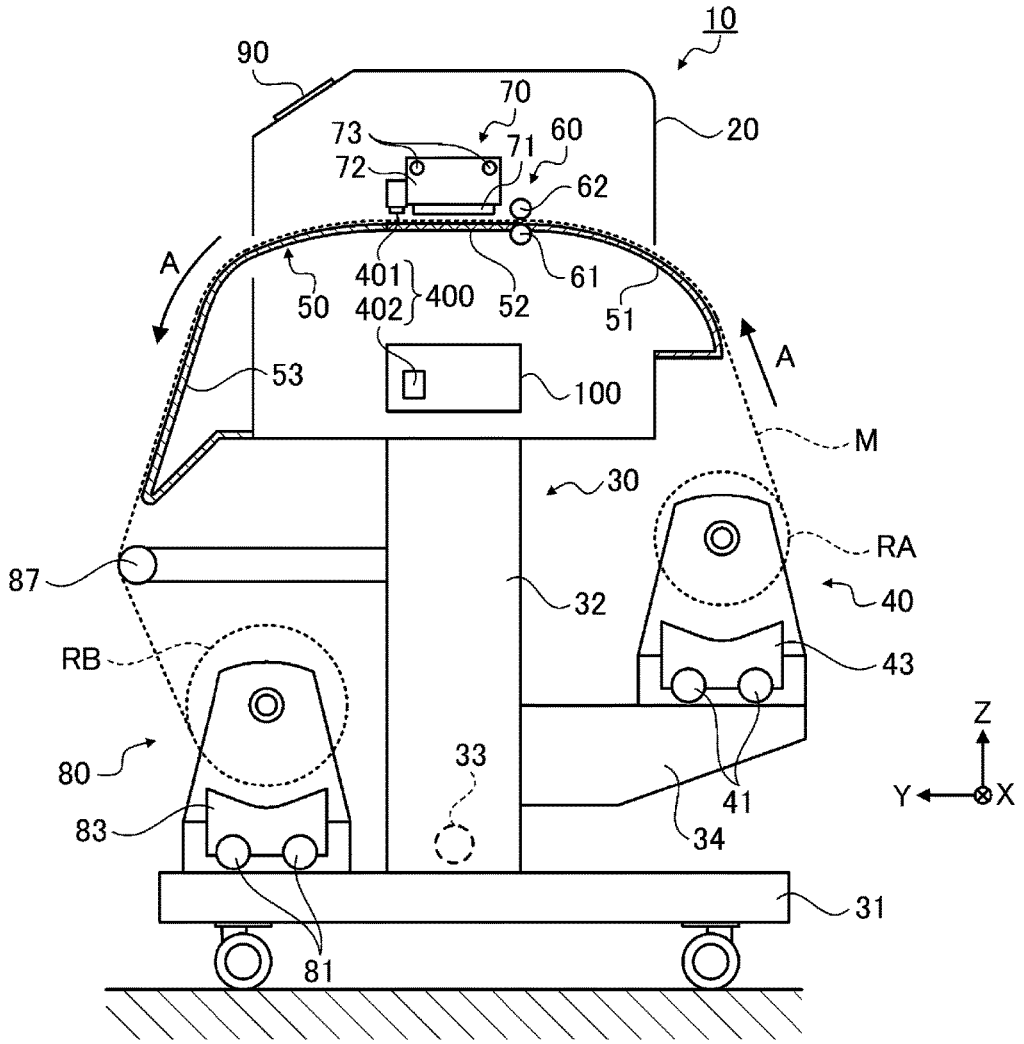
FIG. 7 is a cross-sectional side view illustrating an example configuration of a printing apparatus.

FIG. 7 is a cross-sectional side view illustrating a configuration of a printing apparatus 10 according to a modification example 4. In one embodiment described above, in order to prepare the data table, the amount of slip is determined on the basis of the advance evaluation in which the actual transported length of each roll-paper strip M is measured against the transporting rate set in advance. This measurement is conducted, for example, by way of actual measurement of length of a printed scale image. On the other hand, a printing apparatus 10 according to the modification example 4 includes, in addition to the printing apparatus 10 in FIG. 1, a transporting rate detection section 400 for detecting the transporting rates of roll-paper strips M. In addition, the tension-imparting section 440 imparts respective amounts of tensile force, that are set according to the detected transporting rates, individually to corresponding roll-paper strips M.

The transporting rate detection section 400 includes, for example, an imaging device 401 that images the surface profile of each transported roll-paper strip M and an image processing portion 402 that can recognize and process images taken by the imaging device 401. The imaging device 401 is disposed on the front side surface of the carriage 72 (on the +Y side surface of the carriage 72) and can image the surface profile of each roll-paper strip M that is transported on the transport path by the transport section 60. The imaging device 401 moves together with the carriage 72 in the X-axis direction. When a plurality of roll-paper strips M are installed, the imaging device 401 can perform imaging at any position in the width direction. The imaging device 401 images the surface of each roll-paper strip M and sends the images to the control unit 100.

The image processing portion 402 is included in the control unit 100 as a function portion (i.e., as a software program) of the control unit 100. The image processing portion 402 is capable of recognizing images received and determining the traveling rate (i.e., transporting rate of the transport section 60) of each roll-paper strip M based on the acquired images. The traveling rate of a roll-paper strip M can be detected, for example, by comparing images (images of surface irregularities or of a pattern printed by the printing section 70) of a roll-paper strip M before and after movement within the same field of vision. In other words, by including the transporting rate detection section 400, the printing apparatus 10 can measure the actual transported length against the transporting rate that is set in advance and thereby can obtain information on the amount of slip in transport by the transport section 60 (i.e., transport error) for each roll-paper strip M.

With the printing apparatus 10 according to the present modification example, the amount of slip (transport error) of each roll-paper strip M may be obtained before carrying out printing. The tension-imparting section 440 imparts an amount of tensile force for correcting the detected amount of slip individually to the corresponding roll-paper strip M.

According to the present modification example, the printing apparatus 10 includes the transporting rate detection section 400. Thus, the printing apparatus 10 can detect the actual transported length, which is compared to that of the predetermined transporting rate of each roll-paper strip M to be transported (in other words, the printing apparatus 10 can detect the amount of slip in transport, i.e., transport error). In addition, the tension-imparting section 440 individually imparts a predetermined amount of tensile force set in accordance with the detected transporting rate to the corresponding roll-paper strip M. This enables appropriate correction when the amount of slip in transport by the transport section 60 (transport error) become different depending on the roll-paper strip M. In effect, the corrections can be applied individually to the paper strips based on corresponding determined transport errors.

Note that the printing apparatus 10 may detect the amount of slip in real time while performing printing and impart the tensile force suitable for the amount of slip individually to the corresponding roll-paper strip M. By using this method, appropriate correction can be carried out when the amount of slip fluctuates even if the roll-paper strip M is of the same type. The imaging device 401 need not be installed on the carriage 72. A plurality of the imaging devices 401 (the same number of installed roll-paper strips M) may be disposed at positions where the imaging devices 401 can image respective surface profiles of a plurality of transported roll-paper strips M. Alternatively, a plurality of the imaging devices 401 may be disposed in the second medium support 52. In this case, each of the imaging devices 401 is formed so as to be installed on the bottom side of the second medium support 52 and so as to be able to image the bottom profile of each of the transported roll-paper strips M through an imaging window formed in the second medium support 52. The imaging device 401 images bottom surface irregularities or a pattern printed in advance, and the image processing portion 402 recognizes images received and detects the traveling rate of each roll-paper strip M.

Modification Example 5

In one embodiment, the tension-imparting section 440 includes the first motor 442 and the second motor 452, which are rotational drive devices for rotationally driving rolls RA in the supply section 40. However, the tension-imparting section 440 is not limited to this configuration. For example, the tension-imparting section may include a device that applies a rotational load to an idler roller disposed upstream of the transport section 60 on the transport path on which each roll-paper strip M is transported.

Figure 8:
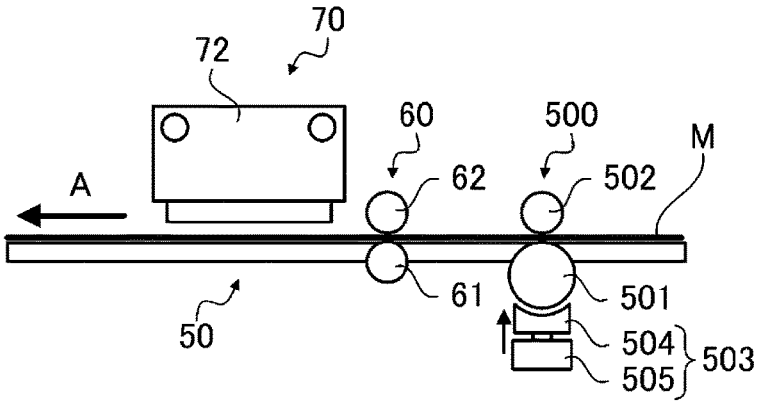
FIG. 8 is a view schematically illustrating an example configuration of a tension-imparting section included in a printing apparatus.

FIG. 8 is a view schematically illustrating a configuration of a tension-imparting section 500 included in the printing apparatus 10 according to a modification example 5. The tension-imparting section 500 includes components such as an idler roller pair (idler rollers 501 and 502) and a braking section 503 that applies a rotational load to the idler roller 501 of the idler roller pair. The tension-imparting section 500 is disposed upstream of the transport section 60 on the transport path on which a roll-paper strip M is transported. The idler roller pair (idler rollers 501 and 502) nips a roll-paper strip M transported by the transport section 60. The idler roller pair is passively rotated in conjunction with movement of the roll-paper strip M. The braking section 503 is formed of components such as a sliding member 504 that comes into contact with a rotating portion (rotating member) of the idler roller 501 and a pressing portion 505 that presses the sliding member 504 against the rotating portion of the idler roller 501.

The pressing portion 505, which is controlled by the control unit 100, can apply a rotational load against rotation of the idler roller 501 by pressing the sliding member 504 against the rotating portion of the idler roller 501. When the rotational load is applied to the idler roller 501, the idler roller pair (idler rollers 501, 502) acts as a brake against movement of a roll-paper strip M. In other words, the braking action of the idler roller pair (idler rollers 501, 502) imparts a tensile force against the transporting force provided by the transport section 60. The control unit 100 can control the amount of tensile force applied against the transporting force by controlling the pressing force of the pressing portion 505.

According to this modification example, the tension-imparting section 500 is disposed upstream of the transport section 60 on the transport path on which roll-paper strips M are transported. Thus, when the amounts of slip in transport by the transport section 60 (transport errors) become different among a plurality of roll-paper strips M, for example as discussed herein—the tension-imparting section 500 can correct the transport errors by imparting tensile forces that act on respective roll-paper strips M in a direction opposite to the transporting forces applied by the transport section 60. In addition, the tension-imparting section 500 includes respective idler roller pairs (idler rollers 501, 502) that are passively rotated in conjunction with the transport of roll-paper strips M. The tension-imparting section 500 controls respective tensile forces that are imparted individually to a plurality of roll-paper strips M by controlling rotational loads applied to the idler rollers 501. Each of the rotational loads applied to the idler rollers 501 can be easily provided as a sliding resistance by pressing the sliding member 504 against the rotating portion of the idler roller 501. Thus, by controlling the pressing force of each sliding member 504 individually, respective tensile forces imparted individually to a plurality of roll-paper strips M can be controlled in a simple and easy way. In one example, each roll-paper strip may be associated with corresponding idler rollers. Further, the idler rollers may be disposed downstream of the supply section.

Modification Example 6

Figure 9:
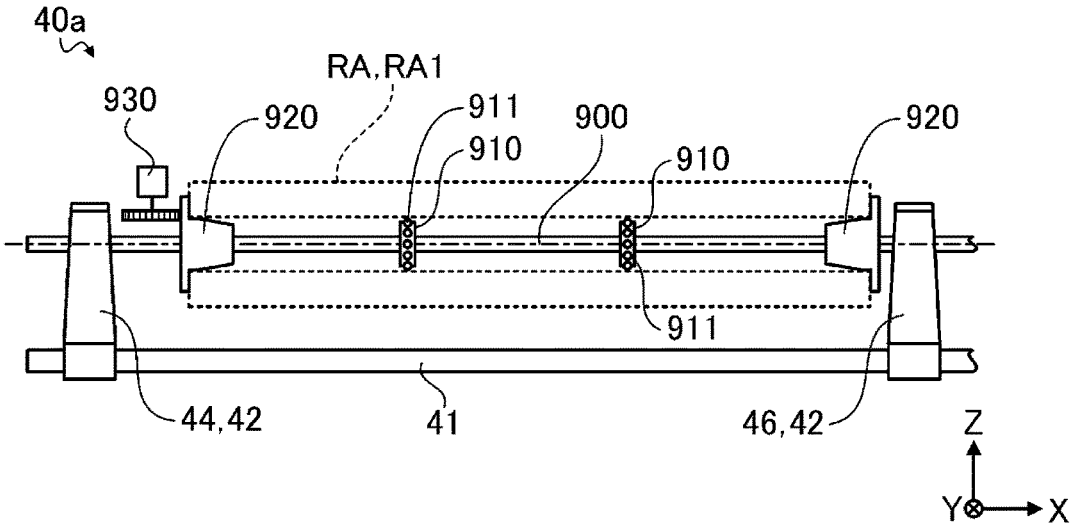
FIG. 9 is a rear view illustrating an example configuration of a supply section.

FIG. 9 is a rear view illustrating a configuration of a supply section 40*a* according to a modification example 6 when the supply section 40*a* is viewed from behind the printing apparatus 10 (from the −Y side). FIG. 9 shows a −X side portion of the supply section 40*a*. In the embodiment 1 as illustrated in FIG. 3, the supply section 40 is described, by way of example, as including the roll holding portions 42 that rotatably holds rolls RA, and the roll holding portions 42 use rotators (first rotator 441, second rotator 451, intermediate rotators 461, 462) that rotate together with respective rolls RA while the rotators are inserted in the ends of core tubes of the rolls RA. However, when a roll RA is wide or thick with a roll-paper strip M and becomes heavy, the configuration in which both ends of the roll RA are only portions to be supported may encounter a problem in which the roll RA may deform (or warp) by its own weight.

On the other hand, as illustrated in FIG. 9, the supply section 40*a* according to the modification example 6 is configured to support a roll RA also at middle portions thereof. The supply section 40*a* includes bearing disks 910 and rotators 920. The roll holding portions 42 support a spindle 900 that is inserted in the core tube of a roll RA and that extends through the center of the bearing disks 910 and the rotators 920. The bearing disk 910 is a disk that is disposed inside the core tube of a roll RA and rotatably supports a roll RA. The bearing disk 910 has a bearing (not shown) that is in contact with the spindle 900 at the center of the bearing disk 910. The bearing disk 910 also has a bearing 911 having the outer periphery that is in contact with the inner surface of core tube of the roll RA. In addition, the rotators 920 engage both ends of the core tube of the roll RA. Each of the rotators 920 has a bearing (not shown) that is in contact with the spindle 900 at the center thereof.

A motor 930, which rotationally drives a rotator 920, is coupled to the rotator 920 that engages the first end (−X side end) of core tube of the roll RA1 that is installed in the −X side supply section 40*a* in the X-axis direction. Another motor 930, which rotationally drives another rotator 920, is coupled to the rotator 920 that engages the second end (+X side end) of core tube of the roll RA2 (not shown) that is installed in the +X side supply section 40*a* in the X-axis direction.

With this configuration, the control unit 100 controls rotation of the motors 930 so as to be able to impart tensile forces as described in the embodiment 1 to respective rolls RA1 and RA2.

Modification Example 7

In any of the embodiment and modification examples, the tension-imparting section is provided upstream of the transport section 60 on the transport path on which a roll-paper strip M is transported. However, a tension-imparting section may be provided downstream of the transport section 60 on the transport path. In the printing apparatus 10 according to the present modification example, the tension-imparting section may be provided in the winding section 80.

More specifically, the tension-imparting section is formed, in the winding section 80, of the first motor 842 that rotationally drives the first rotator 841 and the second motor 852 that rotationally drives the second rotator 851. The control unit 100 causes the first motor 842 and the second motor 852 to impart respective front tensions (tensile forces applied from the downstream side of the transport section 60) to the roll-paper strips M1 and M2. More specifically, the amounts of slip (transport errors) are obtained for roll-paper strips M by conducting evaluations similar to that described in herein (i.e., evaluation in which the actual transported length is measured for each roll-paper strip M against the predetermined transporting rate). The amounts of front tension are controlled such that the amounts of slip become small and equivalent or similar between roll-paper strips M. The front tension may not be opposite to the transport force imparted by the transport section.

The configuration, in which the tension-imparting section is provided downstream of the transport section 60 on the transport path, can also provide advantageous effects similar to those described in association with the embodiments discussed herein.

Note that in any of the embodiment and modification examples, the printing apparatus 10 preferably generate print data so as to perform desired printing on roll-paper strips M in the state in which the amounts of slip become equal or similar to each other after tensile forces are applied and transport errors are corrected (in other words, so as to obtain print images having desired dimensions in the transport direction).

What is claimed is:

1. A printing apparatus comprising:

a supply section that supports a plurality of rolls on which respective printing media are wound and that supplies the printing media;

a transport section that imparts respective transporting forces onto the supplied printing media and that transports the printing media;

wherein the transport section has common transport rollers that transport the printing media side by side;

a printing section that performs printing on the transported printing media; and for each of the plurality of rolls, a corresponding tension-imparting section that imparts a corresponding tensile force onto the corresponding printing media against the corresponding transporting forces, each of the corresponding tensile forces being independent from each other.

2. The printing apparatus according to claim 1, wherein the printing section has a common printing head that performs printing on the printing media.

3. The printing apparatus according to claim 1, wherein the corresponding tension-imparting section imparts, onto the corresponding printing media, individual respective tensile forces of which amounts are set according to types of the printing media.

4. The printing apparatus according to claim 1, further comprising a medium recognition section that recognizes respective types of the printing media, wherein the corresponding tension-imparting section imparts, onto the corresponding printing media, individual respective tensile forces of which amounts are set according to recognized types of the printing media.

5. The printing apparatus according to claim 1, further comprising a width detecting section that detects respective widths of the printing media, wherein the corresponding tension-imparting section imparts, onto the corresponding printing media, individual respective tensile forces of which amounts are set according to detected widths of the printing media.

6. The printing apparatus according to claim 1, further comprising a transporting rate detection section that detects respective transporting rates of the printing media, wherein the corresponding tension-imparting section imparts, onto the corresponding printing media, individual respective tensile forces of which amounts are set according to detected transporting rates.

7. The printing apparatus according to claim 1, further comprising an input section into which respective transport characteristics of the printing media are entered, wherein the corresponding tension-imparting section imparts, onto the corresponding printing media, individual respective tensile forces of which amounts are set according to the entered transport characteristics.

8. The printing apparatus according to claim 1, wherein the corresponding tension-imparting section has respective rotational drive devices that rotationally drive the rolls in the supply section, and the corresponding tension-imparting section controls individual respective tensile forces applied to the printing media by controlling respective driving torques that drive the rotational drive devices.

9. The printing apparatus according to claim 1, wherein the corresponding tension-imparting section is disposed upstream of the transport section on a transport path on which the printing media are transported.

10. The printing apparatus according to claim 1, wherein the corresponding tension-imparting section is disposed upstream of the transport section on a transport path on which the printing media are transported and has idler rollers that are passively rotated in conjunction with transport of the printing media, and the corresponding tension-imparting section controls individual respective tensile forces applied to the printing media by controlling respective rotational loads applied to the idler rollers.

* * * * *